United States Patent [19]

Oshikoshi et al.

[11] Patent Number: 4,911,478

[45] Date of Patent: Mar. 27, 1990

[54] BOOKLET WITH PHOTOGRAPH AND PERSONAL INFORMATION

[75] Inventors: Yuji Oshikoshi; Yoshimi Sugamuma, both of Tokyo; Hiroshi Hara, Kanagawa; Kazuo Shiota, Kanagawa; Nobumitsu Takehara, Kanagawa; Kiichiro Sakamoto, Kanagawa, all of Japan

[73] Assignee: Fuji Photo Film Co., Ltd., Kanagawa, Japan

[21] Appl. No.: 263,853

[22] Filed: Oct. 28, 1988

[30] Foreign Application Priority Data

| | | | |
|---|---|---|---|
| Oct. 28, 1987 | [JP] | Japan | 62-272370 |
| Mar. 4, 1988 | [JP] | Japan | 63-51199 |
| Mar. 4, 1988 | [JP] | Japan | 63-51200 |

[51] Int. Cl.[4] ..... B42D 15/00

[52] U.S. Cl. ..... 283/109; 283/74; 283/75; 283/77; 283/82; 283/904

[58] Field of Search ..... 283/74–75, 283/77, 82, 9, 904, 83, 109; 430/10, 12; 355/109; 156/87, 289

[56] References Cited

U.S. PATENT DOCUMENTS

| | | | |
|---|---|---|---|
| 3,505,140 | 4/1970 | Dunn | 156/289 |
| 3,647,442 | 3/1972 | Malster | 283/904 |
| 3,928,863 | 12/1975 | Stewart et al. | 354/109 |
| 4,287,285 | 9/1981 | Mosehauer | 283/109 |
| 4,500,626 | 2/1985 | Naito et al. | 430/223 |
| 4,536,015 | 8/1985 | Kirstein | 283/904 |
| 4,687,526 | 8/1987 | Wilfert | 283/77 |

*Primary Examiner*—Douglas D. Watts
*Assistant Examiner*—Thomas Hamill, Jr.
*Attorney, Agent, or Firm*—Sughrue, Mion, Zinn, Macpeak & Seas

[57] ABSTRACT

A personal booklet with a picture and personal data of the bookholder, such as a passport for providing the bookholder's identity, comprises transparent and supporting sheets bound in the booklet separately from and adjacent to each other, and an identification data bearing sheet with an image receiving layer formed on a surface thereon. The image receiving layer includes a composite image of the picture and the personal data, and optically readable personal data of the bookholder described by optically readable characters such as font type numbers and/or alphabets. The transparent sheet and the supporting sheet are adhered with adhesive layers to sandwich the identification data bearing sheet therebetween.

17 Claims, 15 Drawing Sheets

1
1a
1b
1c
1d
2
3
4a
4b
5
6a
6b
7
9

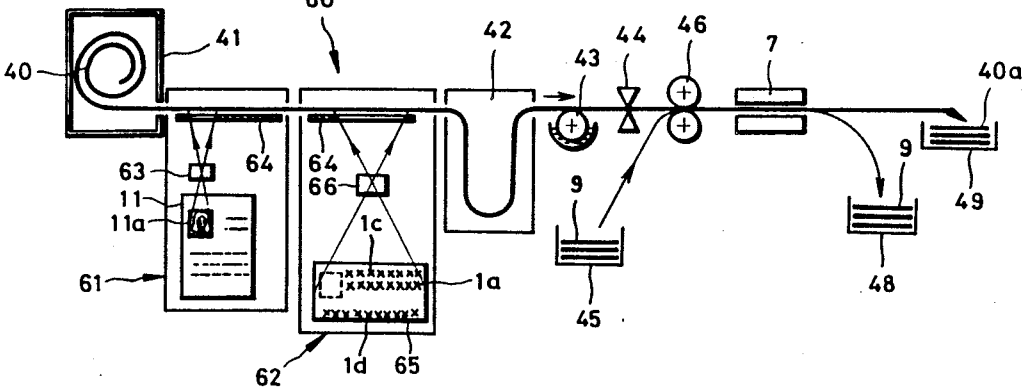
FIG. 9
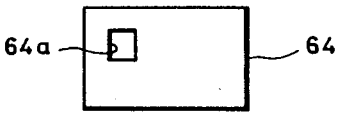
FIG. 10 A
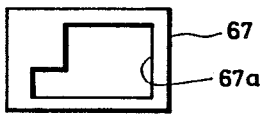
FIG. 10 C
FIG. 10 B
FIG. 10 D

BOOKLET WITH PHOTOGRAPH AND PERSONAL INFORMATION

BACKGROUND OF THE INVENTION

The present invention relates to personal booklets with photographs, and more particularly to personal booklets having a page with a composite image comprising a picture of the bookholder and personal data relating to the bookholder.

Personal booklets such as passports, bankbooks, and so forth have a picture of the bookholder attached to one of the pages thereof as well as personal data of the including the name, nationality, date of birth, sex, date of issue, a personal identification number, and so forth to provide the bookholder's identity. The picture is covered by a transparent sheet and embossed with a seal in order to prevent forgery or alteration of the passport.

The passports are made by at least steps entering the necessary personal data; attaching a picture of the face of the applicant; and covering the attached picture with a transparent cover sheet. Such process is laborious and is inefficient when simultaneously processing a large number of passports. Consequently, the conventional process of making the passports hinders the issuance of the passports.

When applying for a passport, the applicants must supply, in addition to a picture of the applicant to be attached to the passport, an extra picture to be attached to an application form.

In recent years, with the growth of international passengers, machine readable passports (MRPs), machine, have been experimentally introduced at airports of some countries in an attempt to relieve the confusion of passport control for the entry into, and departure from, a country. These MRPs, standardized in form worldwide, can read either optically, electrically, or visually personal data of the bearer thereon by a particular machine.

The process of (making the machine readable passport requires), in addition to all the above described steps, another step of providing machine readable personal data on the passport. Due to this additional step, it is slower to prepare the machine readable passports, hindering the issuance of passports accordingly.

SUMMARY OF THE INVENTION

Therefore, in view of the foregoing, it is an object of the present invention to provide a personal booklet with a picture and personal data of the bookholder to provide the bookholder's identity which is difficult to forge or alter.

It is another object of the present invention to provide a personal booklet with a picture and machine readable personal data of the bookholder to provide the bookholder's identity which improves the process of making personal booklets.

In accordance with the present invention, the personal booklet comprises a transparent sheet bound in the booklet, a supporting sheet bound in the booklet separately from and next to the transparent sheet, and an image receiving layer formed on one surface of an identification data bearing sheet. The supporting sheet and the transparent sheet are adhered together after a composite image is formed the bookholder's picture and personal data in the image receiving layer of the identification data bearing sheet with the identification data bearing sheet therebetween.

For easy adhesion of the supporting sheet sandwiched and the transparent sheet to each other, the sheets have adhesive layers pre-coated onto one surface thereof. The adhesive layer otherwise, may be formed of double-sided adhesive sheet.

According to a feature of the present invention, a picture of the bookholder or applicant attached to an application form and personal data of the applicant included in the application form are optically printed on a thermal transfer photosensitive printing paper as a composite image. The thermal transfer photosensitive printing paper, optically formed with the composite image, is superimposed on the image receiving layer formed over the identification data bearing sheet. The composite image is developed and transferred onto the image receiving layer in a thermal developing and transfer process. Thereafter, the identification data bearing sheet, with the image receiving layer, is sandwiched between the transparent sheet and the supporting sheet bound in the booklet separately from and adjacent to each other as one page. Afterwards or before if desirable, optically readable personal data described by optically readable alpha-number characters, is printed on the image receiving layer with ink.

The present invention avoids the necessity of attaching an applicants picture and typing personal data directly on a booklet page, accordingly. Consequently booklets with pictures can be prepared automatically and efficiently. For example, when making passports with pictures, no extra picture is necessary other than a picture attached to an application form. Furthermore, because it is quite easy to include optically readable characters as well as a picture of the applicant in a composite image, the passport made by the present invention can be used as a machine readable passport.

BRIEF DESCRIPTION OF THE DRAWINGS

The description refers to the accompanying drawings in which like reference characters refer to like parts throughout the several views, and in which:

FIG. 9 is a schematic side view of a printing apparatus for optically printing a composite image;

FIGS. 10A to 10D are explanatory illustrations showing exposure framing masks which are used in the printing apparatus of FIG. 9;

DETAILED DESCRIPTION OF THE INVENTION

Figure 1:
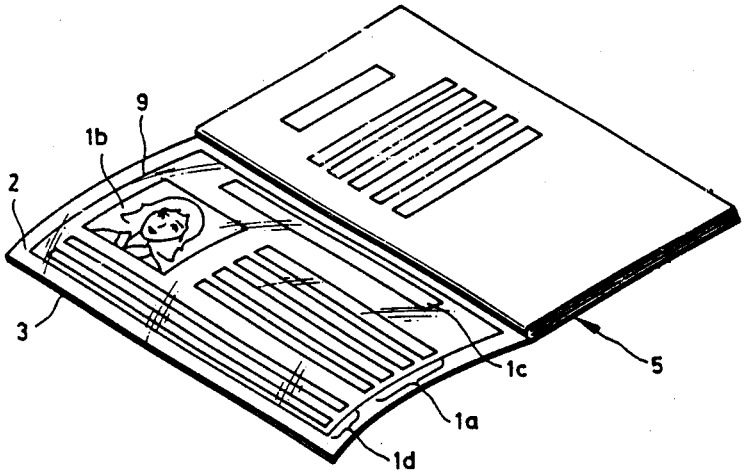
FIG. 1 illustrates a machine readable passport according to a preferred embodiment of the present invention.
Figure 2:
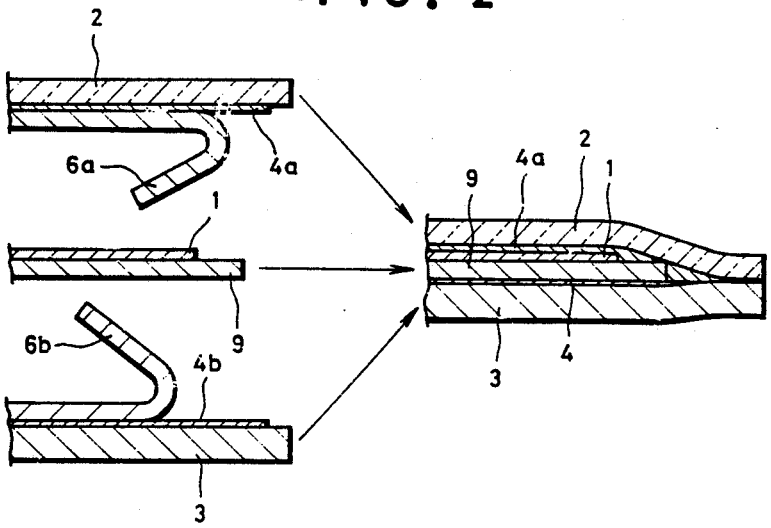
FIG. 2 shows the construction of the machine readable passport of FIG. 1.

FIGS. 1 through 3, there show a machine readable passport (MRP) according to a specific embodiment of the present invention. As shown, the machine readable passport 5 contains a plurality of pages bound as one booklet. One of the pages, for example the cover page, comprises a transparent sheet 2, a supporting sheet 3 adhered to the back of the transparent sheet 2, and an identification data bearing sheet 9 with an image receiving layer 1 of about 0.01 mm thickness coated onto the front surface thereof. On the image receiving layer 1, there is printed personal data 1*a* of the passport holder, a picture 1*b* of the passport holder, a graphic design 1*c*, and optically readable personal data 1*d* of the passport holder described by optically readable alpha numeric characters. The transparent sheet 2 and the supporting sheet 3 are provided with adhesive layers 4*a* and 4*b* heat-weldable to the image receiving layer 1 and the identification data bearing sheet 9. Before adhering the transparent and supporting sheets 2 and 3 to each other, the adhesive layers 4*a* and 4*b* are attached to peelable cover sheets 6*a* and 6*b*, respectively. After peeling the cover sheet 6*b* from the supporting sheet 3, the identification data bearing sheet 9 is placed on the supporting sheet 3 and the transparent sheet 2, with its cover sheet 6*a* peeled away, is overlapped and adhered to the supporting sheet 3 so as to sandwich the identification data bearing sheet 9 therebetween. A coating is applied to the front surface of the passport 5 to form one page of the machine readable passport 5.

The supporting sheet 3, which is used as a front cover of the machine readable passport 5, may have a thickness ranging from 0.1 to 0.8 mm and may be made of any suitable material sheet such as paper, plastic, combined sheets of plastic adhered to paper, or a paper sheet with one or both sides laminated with plastic sheets. The plastic sheet is made, not exclusively but preferably, of polyethylene terephtalete, polycarbonate, acetylcellulose, cellulose ester, polybinilacetate, polystilen, polypropilene, polyvinyl chloride, nylon, polyethylene or the like. It is also preferable to mix white pigments such as $TiO_2$, ZnO etc., or to contain color dyes, in the plastics.

Figures 3A, 3B, 3C:
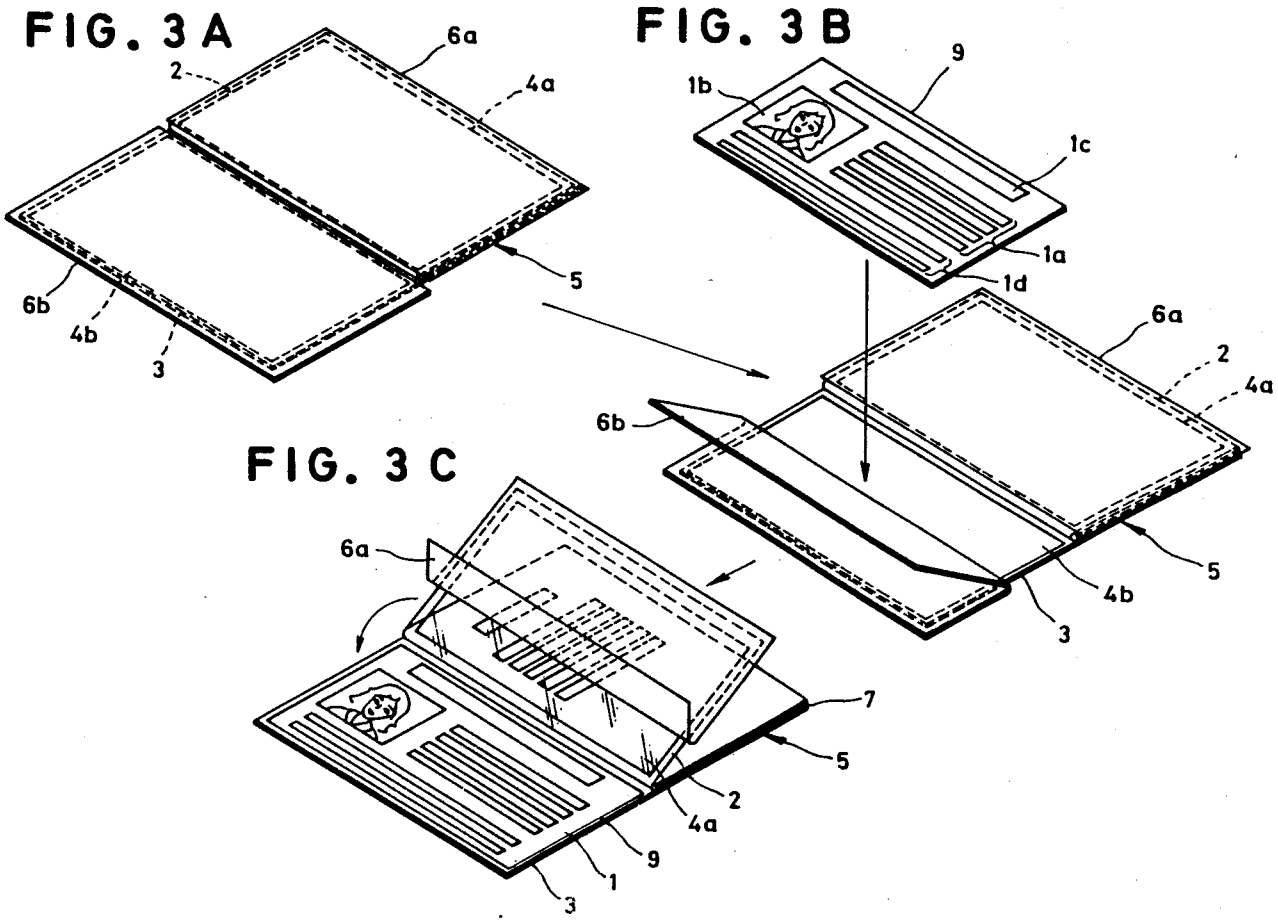
FIGS. 3A to 3C are perspective, exploded illustrations showing a sequence of making the machine readable passport of FIG. 1.

The transparent sheet 2, which is used as the inside page of the front cover, as shown in FIG. 1, is made of a transparent plastic sheet of about 0.05 to 0.35 mm thickness and is sized equivalent to, or slightly smaller than, the supporting sheet 3. Any one of the above-mentioned plastic sheets used for the supporting sheet 3 may also be used for the transparent sheet 2. As shown in FIG. 3B, on the image receiving layer 1 of the identification data bearing sheet 9, the passport holder's picture 1*b* and personal data 1*a*, the graphic design 1*c*, if necessary, and the optically readable special data 1*d* are printed in a thermal transfer process. As described below, the picture, design and data 1*a* to 1*d* are, before printing, laid out and edited on a CRT screen to be composed as a single composite image by a computer. Then, the composite image displayed on the CRT screen is printed on a thermal transfer photosensitive printing paper 40 in a three color frame sequence exposure. Thereafter, the photosensitive printing paper 40 is, developed by a thermal developing process. The developed composite image is finally transferred onto the image receiving layer 1.

The image receiving layer 1 comprises substances including a dye fixer such as dye mordant agents, which can be chemically reactive with dye released from a thermally developable photosensitive layer of the thermal printing paper 40. Any type of dye fixer may be selected according to the properties of dye released from the thermally developable photosensitive layer, the chemical compositions of the thermally developable photosensitive layer, the thermally transferring conditions and so forth. For example, it is preferable to use polymer mordant agents of a high molecular weight are used. The photosensitive thermal printing paper used in this embodiment may be any type of thermal transfer printing color paper. For example, the type of printing paper with releasing dye which is exposed to light and transferred to the dye fixer containing a mordant of printing paper in which agent by the aid of a solvent such as water, the type released dye is transferred to the dye fixer with an organic solvent having a high boiling point, the type of printing paper in which released dye to the dye fixer with a hydrophilic solvent contained in the dye fixer, or the type of printing paper involving diffusing or sublimating released dye to transfer it to the dye fixer, etc. These types of photosensitive thermal transfer printing papers are well known and are disclosed in, for example, U.S. Pat. No. 4,500,626, Japanese Unexamined Patent Publications Nos. 60-133,449, 59-218,443, 61-238,056, and European Patent No. 220,746A2 and so forth.

The adhesive layers 4*a*, 4*b*, having a thickness ranging from 0.001 to 0.2 mm, are provided, respectively, over the back surface of the transparent sheet 2 and the supporting sheet 3 to which the image receiving layer 1 and the identification data bearing sheet 9 are adhered, respectively. Preferably adhesive materials are used for the adhesive layers 4*a*, 4*b* which do not photographically or chemically attack the transferred composite image on the image receiving layer 1, but which quickly adhere the transparent sheet 2 to the image receiving layer 1, or the supporting sheet 3 to the identification data bearing sheet sheet 9, without forming air bubbles therebetween. The adhesive layers 4a and 4b can be applied to the image receiving layer 1 and the identification data bearing sheet 9, respectively, after transforming the composite image onto the image receiving layer 1 in place of applying the adhesive layers to the transparent and supporting sheets 2 and 3, respectively. Otherwise, double-faced adhesive sheets may be used.

The peelable cover sheets 6a and 6b, respectively applied to the adhesive layers 4a and 4b are sized slightly larger than the transparent sheet 2 and the supporting sheet 3, respectively, so that the periphery of the peelable sheets 6a and 6b can be easily picked up between fingers and peeled apart from the adhesive layers 4a and 4b. If it is inconvenient to handle the passport booklet 5 with large-sized peelable cover sheets during the preparation thereof, the peelable sheet 6a and 6b may be sized equal to or smaller than the transparent and supporting sheets 2 and 3 so long as the peelable sheets are larger than the image receiving layer 1.

Figure 4:
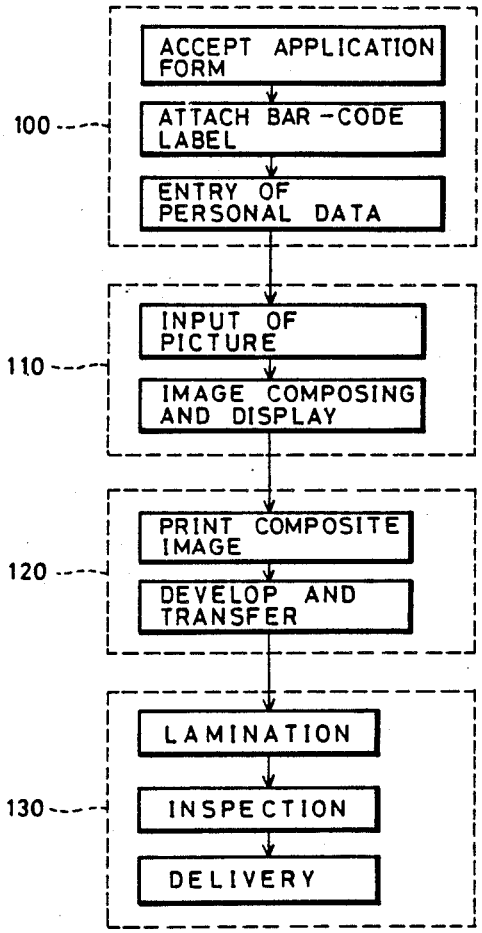
FIG. 4 is a flow chart showing the process of making the machine readable passport of FIG. 1.
Figure 5:
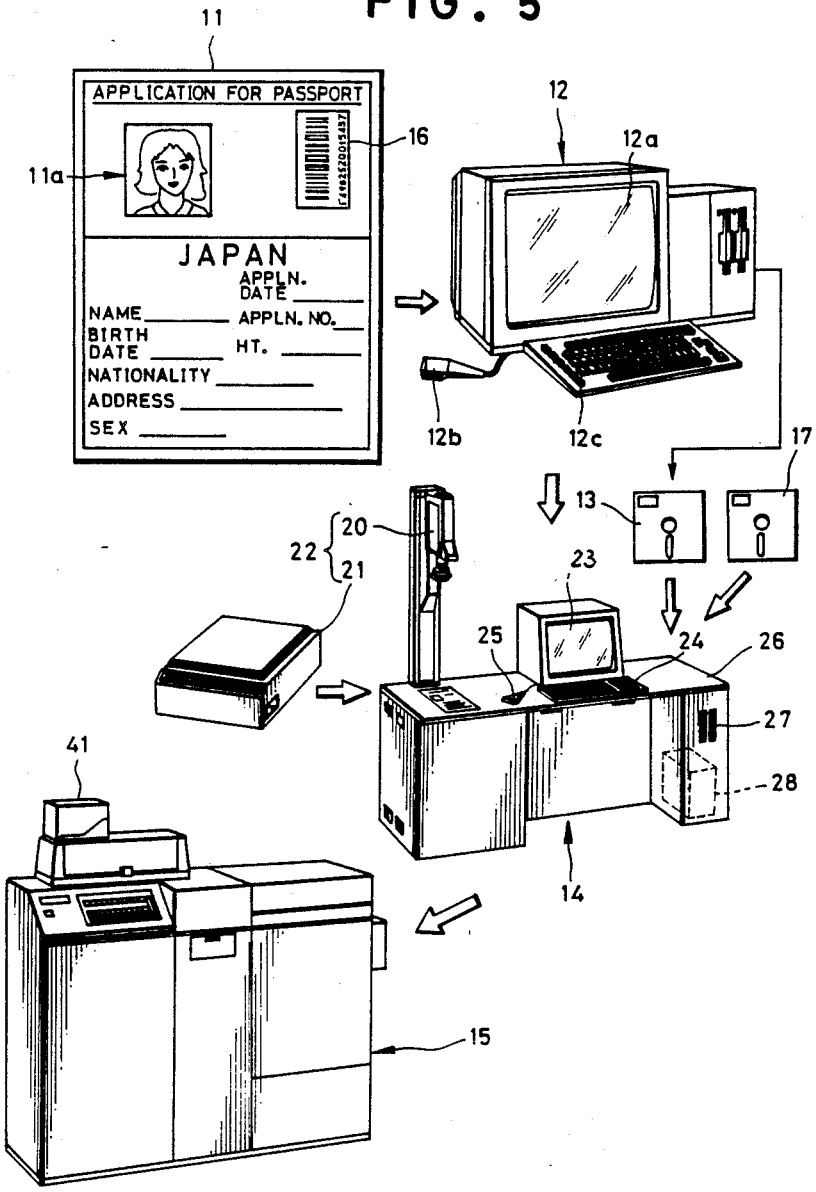
FIG. 5 illustrates a system of making the machine readable passport of the present invention.

The process of making machine readable passports 5 is disclosed from the following description with reference to FIGS. 4 through 7. As shown in FIGS. 4 and 5, the machine readable passport is prepared through a process of four steps, namely a data entry step 100, including the acceptance of an application form, an image composing step 110, a composite image printing step 120 and a finishing step 130.

In the data entry step 100, after attaching a bar-code label 16 carrying a personal identification number to an application form 11, an operator prepares the necessary personal data for describing or identifying the applicant of the machine readable passport. This personal data includes the applicant's name, the date of birth, data from the application form 11, nationality, sex and so forth. In particular, personal data is entered in a word processor 12 having a CRT display 12a, a bar-code reader 12b and a keyboard 12c, and stored in a floppy disk 13. The personal data is stored in the form of coded data along with the personal identifying number read out from the bar-code label 16.

Figure 6:
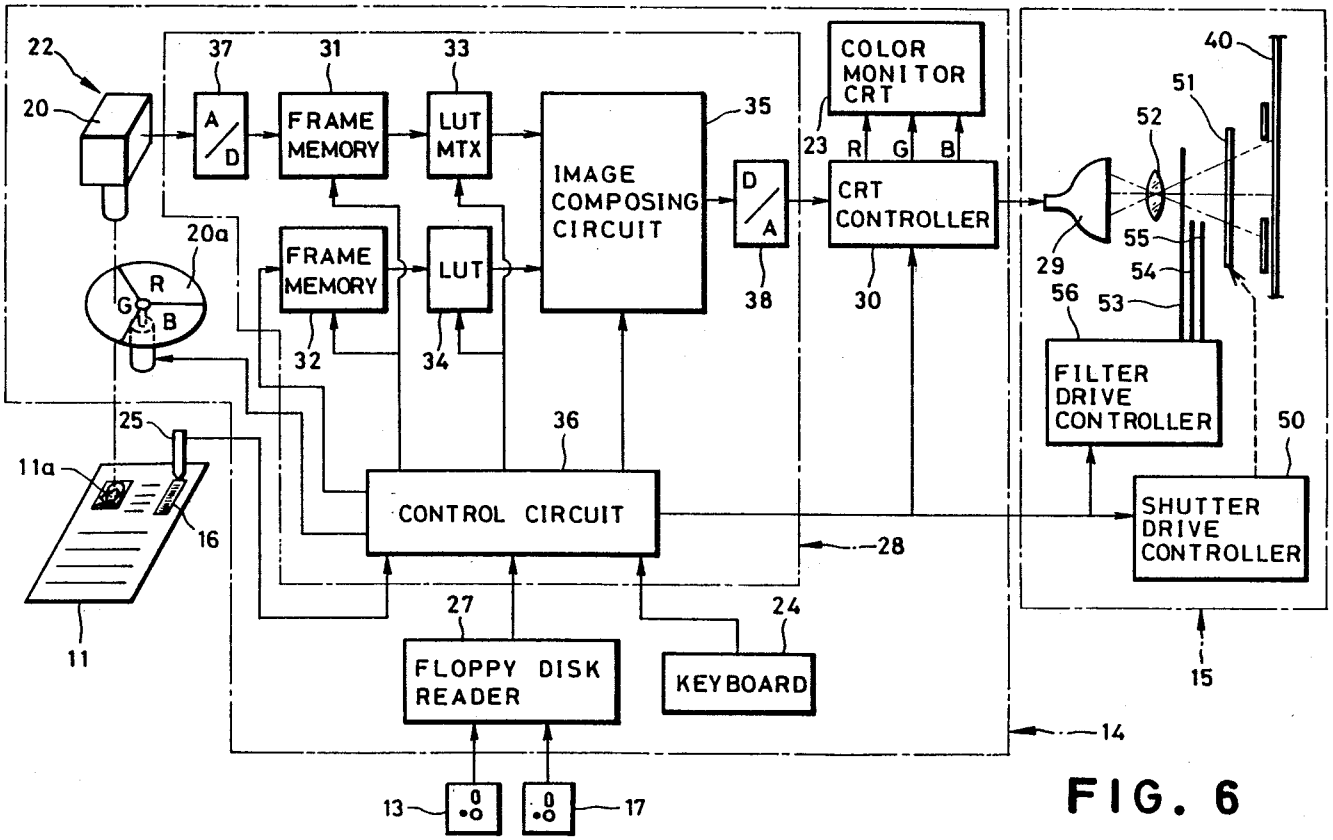
FIG. 6 is a block diagram showing a video printer and an image composing apparatus used in the system of FIG. 5.

In the image composing step 110, an image of the applicant's picture 11a attached to the application form 11 and the applicant's personal data are composed as a single composite image by an image composer 14. For editing a composite image on a color monitor including a color CRT display 23, the operator displays the picture 1b of the applicant's face and the applicant's personal data 1a retrieved from the floppy disk 13 and inputs through a character generator, the graphic design 1c, and the optically readable personal data 1d which are prepared based on the data from the application form 11. The image composer 14, as shown in FIGS. 5 and 6, comprises a picture image input device 22, such as a TV camera 20 or a color image scanner 21, a color monitor CRT display 23, a console 26 having a keyboard 24 and a bar-code reader 25, a data reader 27 for reading the personal data stored in the floppy disk 13 and data of the graphic design stored in the floppy disk 17, an image composing unit 28 comprising a microcomputer for preparing a composite image from the data read from the floppy disks 13 and 17, and a CRT controller 30 for controlling the color monitor CRT 23 and a black-and-white CRT of the video printer 15. Preferably, a black-and-white TV camera is used as the TV camera because of its high resolution. When employing a black-and-white TV camera, it is required a color separating means comprising three primary color filters, namely red, green and blue filters. Each filter must be insertable into the optical axis of the black-and-white TV camera independently of the other two.

The image processing unit 28, as detailed in FIG. 6, reads out the image data of the applicant's picture 1b inputted through the picture image input device 22 and of the applicant's personal data according to the applicant's personal identification number. The image data, the personal data of the applicant, and the graphic design data are stored in frame memories 31 and 32 under the control of a controller 30 and, thereafter. Thereafter, the data are transferred to a look-up table matrix circuit 33 and a look-up table memory 34, respectively, for correcting gradation. Then, the data is composed in the image composing circuit 35. As shown by the arrows in FIG. 6, control circuit 36 controls sequentially each circuit or peripheral device of the image processing unit 28 so as to input images and characters, and then compose these images and characters. Control circuit 36 also controls video printing by the video composer 14 and video printer 15. 37 and 38, A/D and D/A converters, respectively, convert video signals by color.

Figure 7:
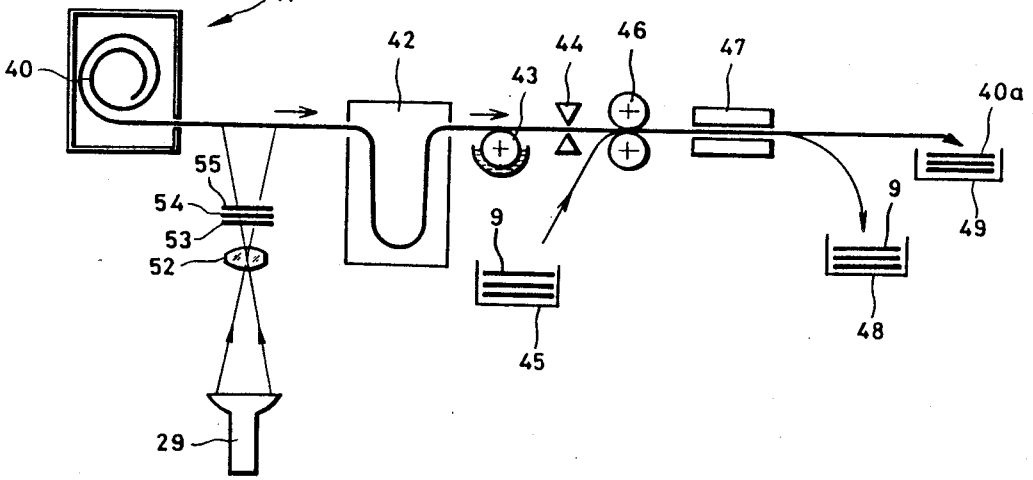
FIG. 7 is a schematic illustration showing a video printer used in the system of FIG. 5.

In the composite image printing step 120, the composite image prepared in the image composing step 110 is printed on the thermal transfer photosensitive printing paper 40. After development, the composite image is transferred onto an image receiving layer 1 of the identification data bearing sheet 9 by the video printer 15 in a thermal transfer process. The video printer 15, as is shown in FIGS. 6 and 7, comprises a paper cassette 41 containing a roll of thermal transfer photosensitive printing paper 40, and a CRT 29 for displaying a composite image to which the printing paper 40 is exposed. The printer also includes an antechamber 42 for retaining the exposed printing paper 40 in the form of a loop, a water applicator 43 disposed after the antechamber 42 for applying water as an activator for promoting thermal transfer process in a uniform layer to the exposed surface of the printing paper 40, and a cutter 44 disposed after the water applicator 43 for cutting the exposed printing paper 40 into individual print strips. Also included is an identification data bearing sheet container 45 in which a number of blank identification data bearing sheets 9 are stored in a stack with their image receiving layers up, a pair of pressure applying rollers 46 for superimposing and applying pressure between the print strip of the exposed thermal printing paper 40 and the image receiving layer 1 of an identification data bearing sheet 9 picked up from the identification data bearing container 45 so as to squeeze out air therebetween, a thermal image printing head 47 for applying heat to the pring strip of the printing paper 40 and the image receiving layer 1 of the identification data bearing sheet 9 superimposed thereon, a container 48 into which the identification data bearing sheet 9 with a composite image transferred thereto is stacked, and a wastepaper container 49 into which the used print strip 40a of the printing paper 40 is discarded.

The printing CRT 29 sequentially displays a composite image as a black-and-white image in the form of a brightness pattern by color which is projected onto the printing paper 40 by means of a printing lens 52 during the opening of a shutter 51 controlled by a shutter controller 50. For translating each black-and-white image into a corresponding monochromatic image, there are provided three color filters, namely blue, green and red 53, 54 and 55, respectively, which are inserted into a printing path, defined by the printing lens 52, independently of each other so as to perform a three color frame sequence exposure. Filters 53, 54, and 55 are controlled by filter drive controller 56. As shown by the arrows in FIG. 6, filter drive controller 56 is actuated by a signal from the control circuit 36 during video printing, and selectively drives the blue, green, and red filters, 53, 54, and 55, respectively, to insert one of them into the printing path. The printing CRT 29 may be replaced with any well known image display devices such as LED image display devices, LC image display devices, laser image display devices or the like.

The thermal transfer photographic printing paper 40, after having been exposed, is intermittently transported into the antechamber 42. After passing the antechamber 42, the water applicator 43 applies water to the exposed surface of the printing paper 40. The application of water by the water applicator 43 may be omitted. If the image receiving layer 1 contains a heat soluble activator for promoting thermal image transfer process such as ureas, crystallized water, micro-capsules or the like.

After the application of water, the exposed printing paper 40 is cut into print strips by the cutter 44. Each print strip is laid on top of the image receiving layer 1 of an identification bearing sheet 9 picked up from the identification data bearing sheet container 45. The pressure applying rollers 46 applies pressure between the print strip and the image receiving layer 1 of the identification data bearing sheet 9 to distribute water applied by the water applicator 43 in a uniform layer over the exposed surface of the print strip of the printing paper 40 and/or the image receiving layer 1. The superimposed printing strip and image receiving layer 1 of the identification data bearing sheet 9 is placed between, and heated by, upper and lower heating plates of the thermal image transfer head 47 so as to develop and transfer the thermal image to the image receiving layer 1 from the print strip of the printing paper 40 in a thermal developing and transfer process. Because of the relatively long time. necessary for the thermal printing step, a plurality of thermal printing heads 47 is preferably used for simultaneously processing a plurality of identification data bearing sheets 9. Thus processed, the identification data bearing sheet 9 is placed into the container 48 while the print strip 40*a* of the printing paper 40 is discarded into the wastepaper container 49.

In the finishing step 130, as is shown in FIGS. 3 and 4, the identification data bearing sheet 9, bearing the image receiving layer 1 with a composite image transferred thereto in a thermal transfer process, is superimposed over, and adhered to, the supporting sheet 3 through the adhesive layer 4*b* and then to the transparent sheet 2 through the adhesive layer 4*a*, thereby forming the first page of the booklet as the machine readable passport 5. Finally, after inspecting the identity between the personal data and the picture of the applicant and so forth, the booklet, as a machine readable passport 5, is delivered to the applicant.

The composite image thermally printed on the passport includes personal data described by optically readable characters which provides the identity of the passport holder. The passport can be used as a machine readable passport which can be verified by an optical character reading machine.

Figure 8:
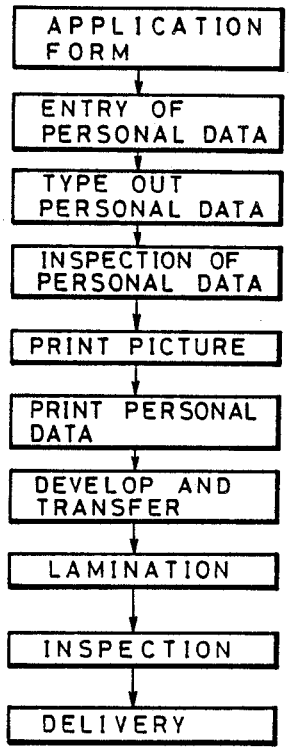
FIG. 8 is a flow chart illustrating another process of making the machine readable passport of the present invention.

Referring now through FIGS. 8 to 10, there is shown an apparatus for making a machine readable passport 5 according to another preferred embodiment of the present invention. As shown in FIG. 9, after having accepted an application form 11 with a picture 11*a* and personal data of the applicant, the necessary personal data is edited and printed out on a data sheet 65 with characters, or common data, and a pattern previously printed thereon by a word processor based on the personal data from the application form 11. After the inspection of the personal data 1*a* and 1*d* printed on the data sheet 65, the photosensitive printing paper 40 is exposed directly to the picture 11*a* of the applicant attached to the application form 11 and, then, to the data sheet 65. The exposed photosensitive paper is developed in a thermal developing process. A composed image on the photosenitive paper, thus developed, is transferred to the image receiving layer formed on the identification data bearing sheet 9. Finally, the identification data bearing sheet 9 is sandwiched between the supporting sheet 3 and the transparent sheet 2 to form the first page of the booklet. After inspecting the composite image, the personal data and, in particular, the coincidence between the picture and the personal data, the booklet is delivered as a machine readable passport 5 to the applicant.

The printing apparatus for making the machine readable passport 5 is shown in FIG. 9. The printing apparatus 60 comprises the paper cassette 41 containing a roll of thermal transfer photosensitive printing paper 40, first exposure means including a printing lens 63 for exposing the photosensitive printing paper 40 to the picture 11*a* of the applicant attached to the application form 11, and second exposure means including a printing lens 66 for exposing the data sheet 65 placed adjacent to the application form 11 onto the same frame of the photosensitive printing paper 40. The printing apparatus further includes the antechamber 42 disposed after the second exposure means for retaining the exposed photosensitive printing paper 40 in the form of a loop, the water applicator 43 disposed after the antechamber 42 for uniformly applying water to the exposed surface of the photosensitive printing paper 40 as an activator for promoting the thermal transfer process, and a cutter 44 disposed after the water applicator 43 for cutting the exposed photosensitive printing paper 40 into individual print strips. Also included is an identification data bearing sheet container 45 in which a number of identification data bearing sheets 9 are stored in a stack with their image receiving layers up, a pair of pressure applying rollers 46 for superimposing and applying pressure between the print strip of the exposed photosensitive printing paper 40 and the image receiving layer 1 of an identification data bearing sheet 9 picked up from the identification data bearing sheet container 45 so as to force out air therebetween, a thermal image printing head 47 for applying heat between the print strip of the photosensitive printing paper 40 and the image receiving layer 1 of the identification data bearing sheet 9 superimposed thereon, a container 48 into which the identification data bearing sheet 9 with an image transferred thereon is stacked, and a wastepaper container 49 into which the used print strip of the photosensitive printing paper 40 is discarded.

The first exposure means 61 includes an illumination lamp (not shown) for illuminating the picture 11*a* on the application form 11 from the upper left of the picture 11*a*, a first printing lens 63 for projecting an image of the picture 11*a* on the application form 11 onto a frame of the photosensitive printing paper 40, and a first exposure framing mask 64 disposed close to the photosensitive printing paper 40 to expose only the picture 11*a* on the application form 11 to the photosensitive printing paper 40.

The second exposure means 62 includes an illumination lamp (not shown) for illuminating the data sheet 65 adjacent the application form 11 from the upper right of the data sheet 65 on which the personal data 1*a*, a graphic image 1*c* and optically readable characters 1*d*, for providing the applicant's identification, are printed. Also included is a second printing lens 66 for projecting an image of the data sheet 65 onto the same frame of the photosensitive printing paper 40 to which the picture 11*a* is exposed, and a second exposure framing mask 65 disposed adjacent to the first exposure framing mask 64 and close to the photosensitive printing paper 40 to expose an image of the data sheet 65 to the photosensitive printing paper 40.

As is shown in FIGS. 10A to 10D, the first and second exposure framing masks 64 and 67 are formed with different openings 64*a* and 67*a*, respectively, for defining exposure areas. Due to the provision of the different framing masks 64 and 67, the images of the picture 11*a* and the data sheet 64 are printed at different positions but on the same frame of the photosensitive printing paper 40.

Figure 11:
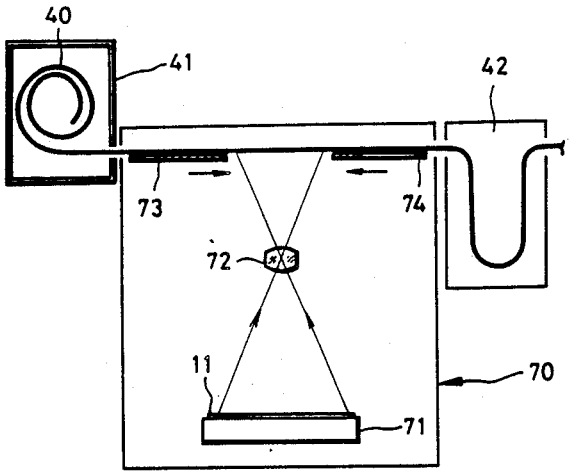
FIG. 11 is a schematic side view of an example of a composite image printing unit of the printing apparatus.

A composite image printing unit 70 may replace first and second exposure means 61 and 62. As is shown in FIG. 11, the composite image printing unit 70 comprises a stationary table 71 on which the application form 11 or the data sheet 65 is placed, a printing lens 72 for projecting an image of the picture 11*a* attached to the application form 11 or the data sheet 65 onto the photosensitive printing paper 40 and first and second framing mask 73 and 74 which are interchangeably placed above the printing lens 72 to define exposure areas similar to those shown in FIGS. 10A and 10B. When the picture 11*a* of the application form 11 is printed, the first framing mask 73 is moved and placed over the printing lens 72. After the printing of the picture 11*a*, the application form 11 is replaced with the data sheet 65. Thereafter, the first framing mask 73 is removed, and the second framing mask 74 is moved and placed over the printing lens 72 for printing the data sheet 65.

Figure 12:
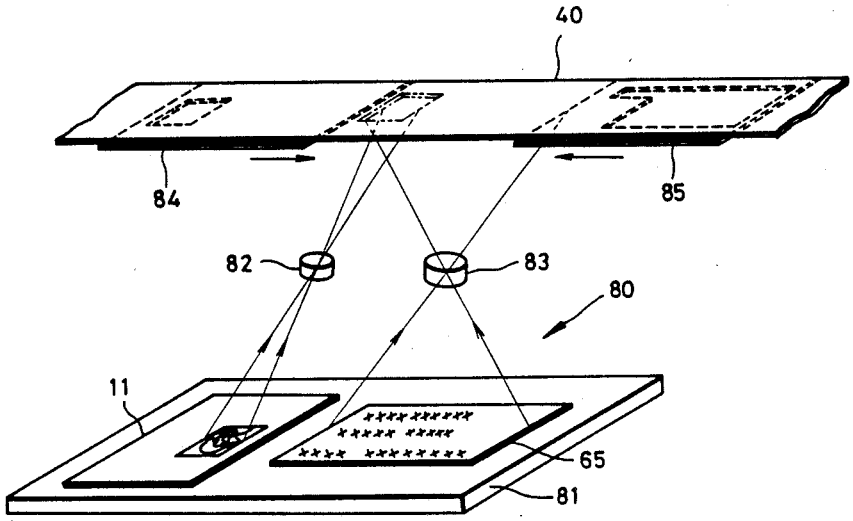
FIG. 12 is a schematic, perspective side view of another example of a composite image printing unit of the printing apparatus.

FIG. 12 illustrates ann alternative composite image printing unit 70. In this alternative, a composite image printing unit 80 is provided with a pair of printing lenses 82 and 83 for projecting images of the application form 11 and the data sheet 65 placed on the table 81 side-by-side. First and second framing masks 84 and 85, which are the same as those of the composite image printing unit 70 of FIG. 11, are interchangeably placed above the table 81 to expose sequentially the images of the picture 11*a* of the application form 11 and the data sheet 65 onto the same frame of the photosensitive printing paper 40. In this embodiment, operation is simplified in comparison with using the composite image printing unit 70 since it is not necessary to replace the application form with the data sheet.

Figure 13:
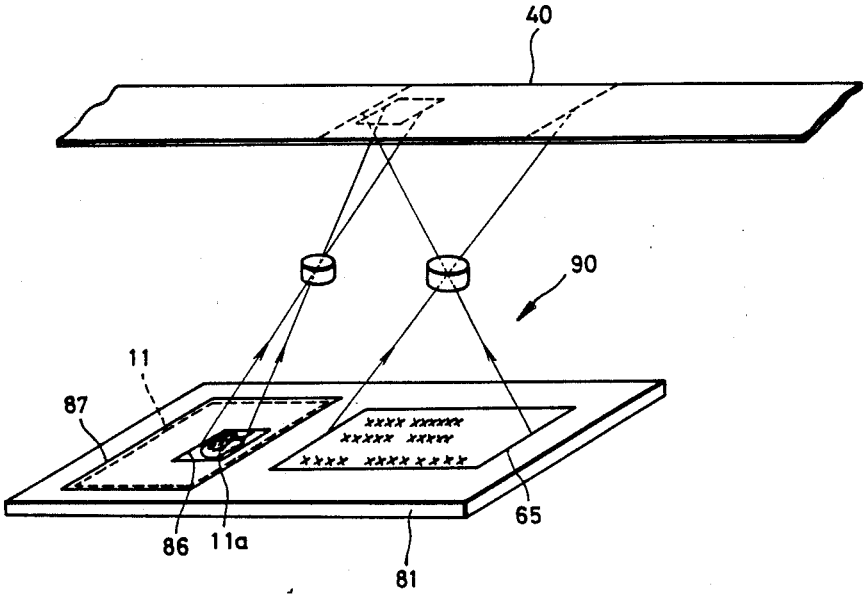
FIG. 13 is a schematic, perspective side view of still another example of a composite image printing unit of the printing apparatus.

FIG. 13 shows still another alternative composite image printing unit in which interchangeable framing masks are not used. In the composite image printing unit 90 of FIG. 13, the application form 11 and the data sheet 65 are placed on the table 81 side-by-side and are simultaneously projected onto a frame of the photosensitive printing paper 40 by means of a pair of printing leanses. However, the application form 11 is covered with a light blocking mask 87 made of, for example a blackened sheet, formed with an opening 86 for exposing the picture 11*a* of the application form 11.

Figure 14:
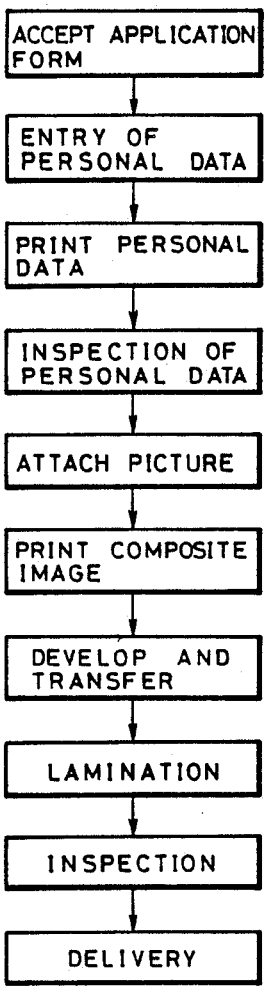
FIG. 14 is a flow chart illustrating the process of making a machine readable passport according to another preferred embodiment of the present invention.

In the case of optically providing a composite image of a picture and personal data, the process of making a machine readable passport according to the present invention may be changed partly as is shown in FIG. 14. In particular, it is possible to replace the steps of first exposing the photosensitive printing paper 40 directly to the picture 11*a* of the applicant attached to the application form 11 and of exposing the same to the data sheet 65 in the process of FIG. 8 by the steps of attaching an extra picture of the applicant, rather than the picture attached to the application form, to the data sheet 65 with the personal data printed thereon and optically exposing the photosensitive printing paper 40 to the data sheet 65.

Figure 15:
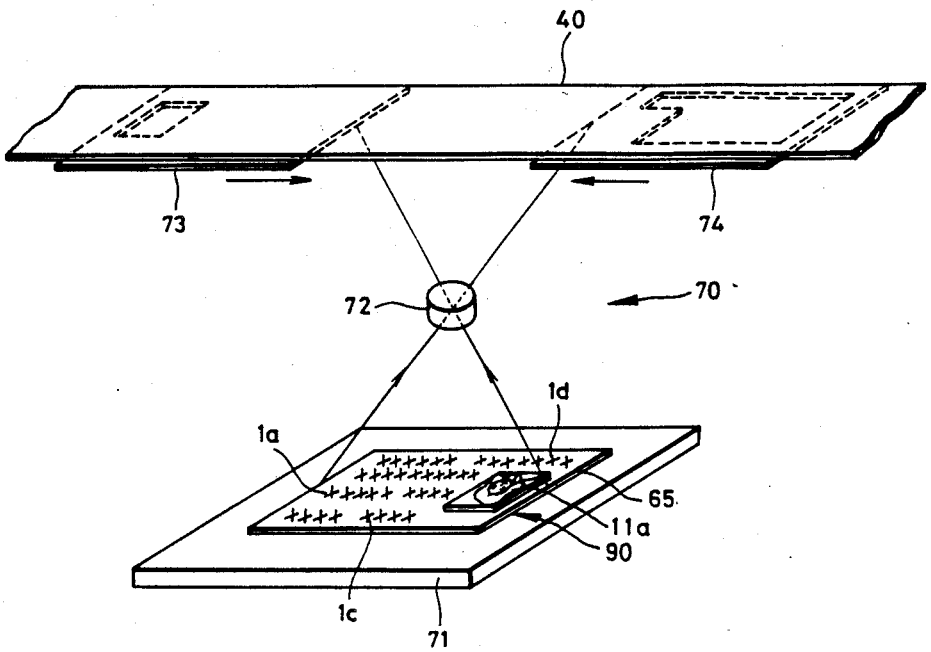
FIG. 15 is a schematic, perspective side view of an example of a composite image printing unit of the printing apparatus for printing a composite image in the process illustrated in FIG. 14.

For exposing the photographic printing paper 40 according to the process of FIG. 14, the composite image printing unit 70 shown in FIG. 11 can be used. FIG. 15 shows the picture 11*a* of the applicant attached to the data sheet 65 provided with the personal data 1*a*, a graphic design 1*c* and optically readable characters 1*d* for providing the passport holder's identity to form an original sheet 90. After placing the original sheet 90 on the table 71, the first framing mask 73 is moved and placed above the printing lens 72 to expose the picture 11*a* of the original sheet 90. Thereafter, the first framing mask 73 is removed, and the second framing mask 74 is moved and placed above the printing lens 72 for exposing the data sheet 65. In the case of exposing the picture 11*a* and the data sheet 65 two separate times, an appropriate exposure time may be selected suitably for each of the picture and the data sheet, resulting in a print with a good image quality. For shortening exposure time, it may be permissible to expose the picture 1*a* and the data sheet 65 on the original sheet 90 simultaneously.

Figure 16:
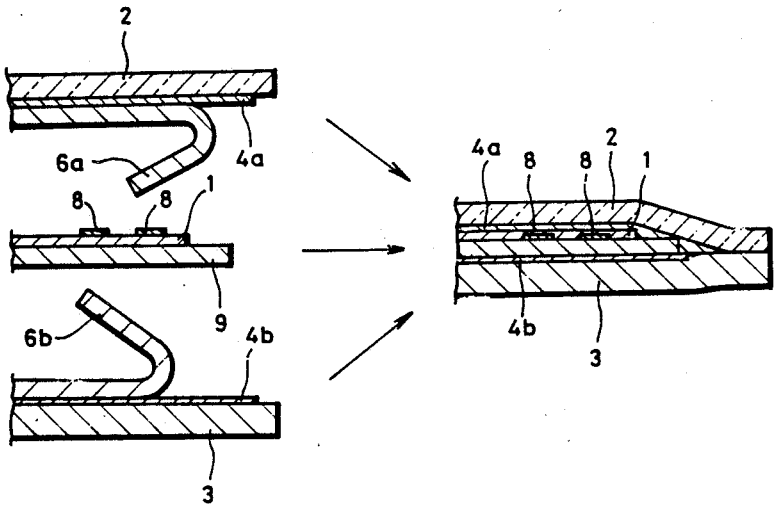
FIG. 16 is an illustration of a machine readable passport according to another preferred embodiment of the present invention.

FIG. 16 shows the construction of a front cover page of a machine readable passport according to another preferred embodiment of the present invention which also has a plurality of pages bound as one booklet. The front cover page comprises a transparent sheet 2 with an adhesive layer 4*a*, a supporting sheet 3 with an adhesive layer 4*b*, and an identification data bearing sheet 9 with an image receiving layer 1 of about 0.01 mm thickness coated on the front surface thereof. On the image receiving layer 1, there is printed a composite image of personal data of a passport holder, a picture of the passport holder and a graphic design formed thereon in the same manner as described in connection with the preferred embodiment. Furthermore, the image receiving layer 1 of the identification data bearing sheet 9 is provided with optically readable personal data which is described with optically readable characters. The optically readable personal data is printed with special ink directly on the image receiving layer in an optically readable personal data area 8. Ink used to print the machine readable personal data may be of any well known type of infrared absorption inks. The optically readable data area 8 may be defined by an ink printable area provided outside of the area of the image receiving layer 1 where the composite image is printed. The transparent sheet 2 and the supporting sheet 3 are provided with the adhesive layers 4*a* and 4*b* which are protected by peelable cover sheets 6*a* and 6*b*, respectively. Before adhering the transparent and supporting sheets 2 and 3, respectively, to each other, the adhesive layers 4*a* and 4*b*, the cover sheets 6*a* and 6*b*, respectively, are peeled apart from the transparent and supporting sheets 2 and 3. After peeling the cover sheet 6b apart from the supporting sheet 3, the identification data bearing sheet 9 is placed on the supporting sheet 3. The transparent sheet 2 then is superimposed and adhered to the supporting sheet 3 so as to sandwich the identification data bearing sheet 9 therebetween, thereby forming the front page of the machine readable passport 5.

Figure 17:
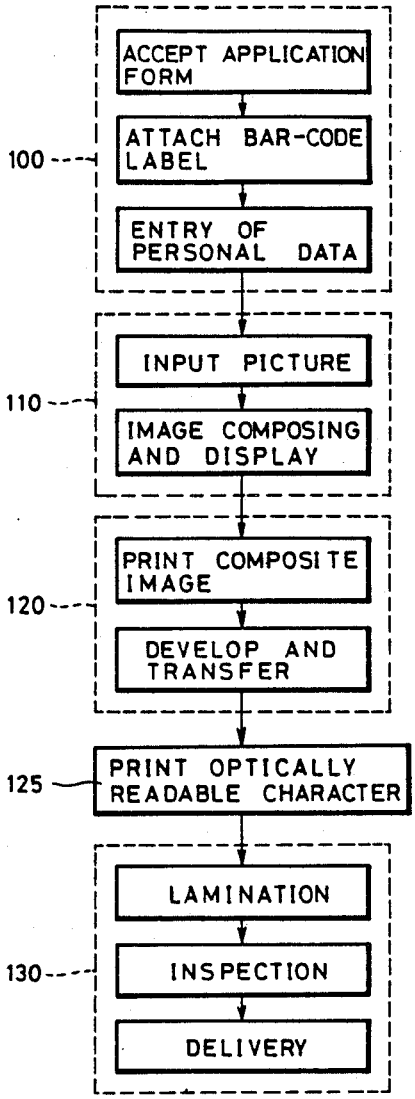
FIG. 17 is a flow chart illustrating the process of making the machine readable passport of the present invention shown in FIG. 16.
Figure 18:
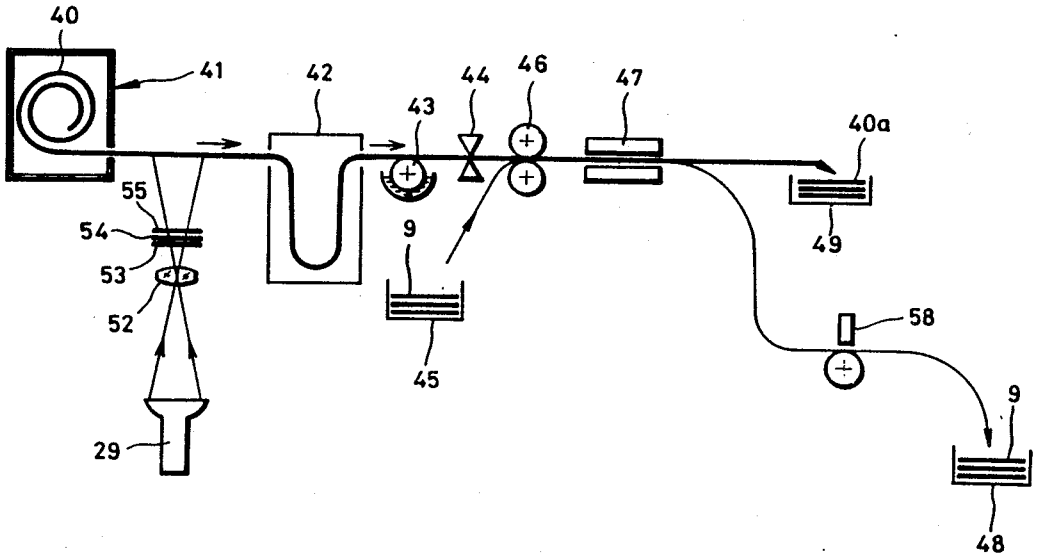
FIG. 18 is a schematic illustration showing a video printer for performing the process shown in FIG. 17.

The process of making the machine readable passport is shown in FIG. 17 in which a step 125 of printing the optically readable data with special ink is included in addition to steps 100, 110, 120 and 130 of the process shown in FIG. 4. The process, with the exception of the optically readable data printing step 125, employs the same apparatus shown in FIGS. 5 to 7 as described earlier. In the optically readable personal data printing step 125, optically readable personal data is printed directly on the image receiving layer 1 of the idenficiation data bearing sheet 9 by a line printer 58 provided in a video printer shown in FIG. 18. The line printer 58 may be of any well known type. The optically readable personal data 1d, described above includes necessary personal data corresponding to the data from the application form 11 and is described by alpha numeric characters, readable by optical character readers (OCRs).

Figure 19:
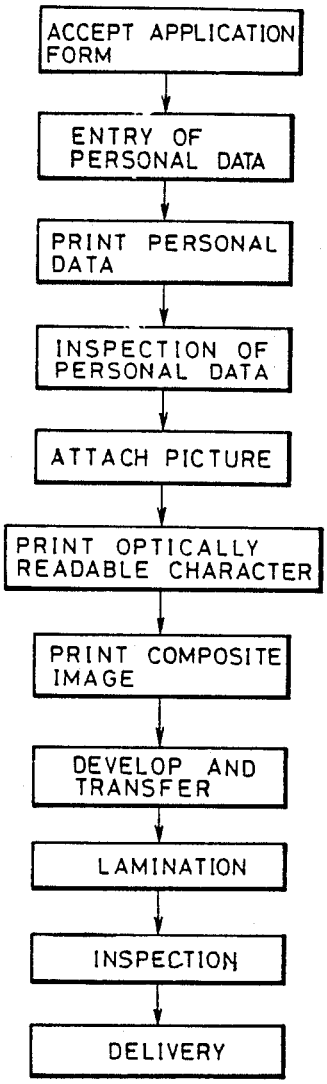
FIG. 19 is a flow chart illustrating the process of making the machine readable passport of the present invention shown in FIG. 16.
Figure 20:
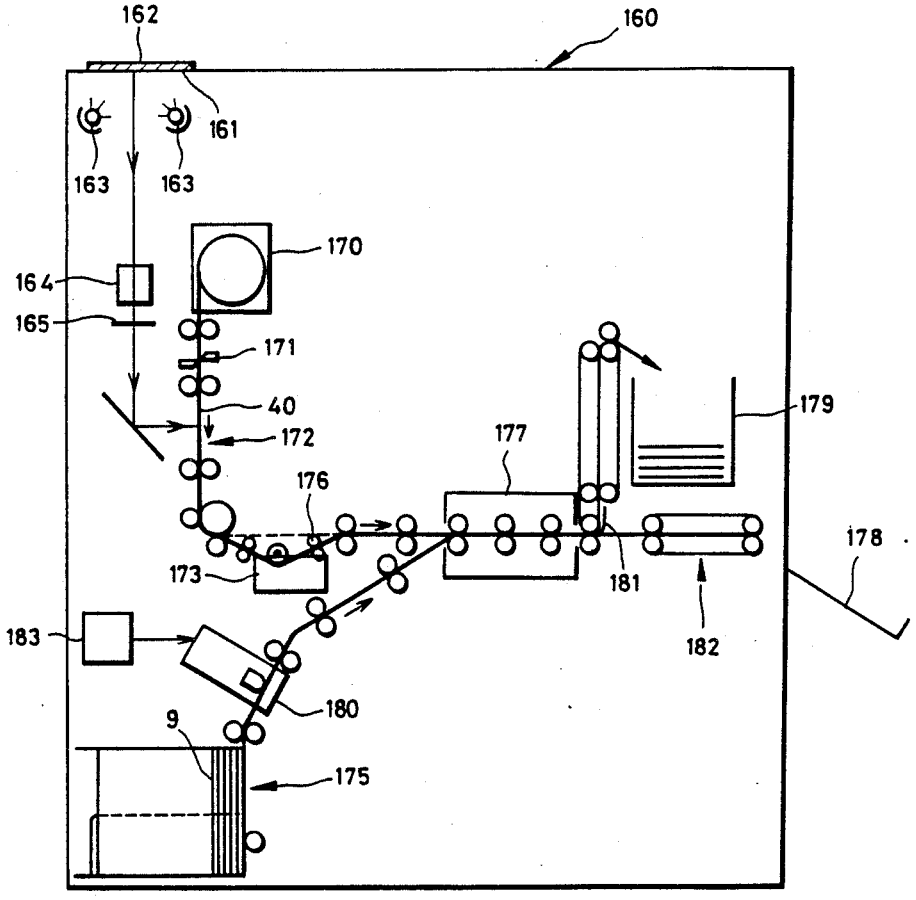
FIG. 20 is a schematic illustration showing a printer for performing the process shown in FIG. 19.

The machine readable passport 5 shown in FIG. 17 is made through the process shown in FIG. 19 in which a step of printing the optically readable data on the image receiving layer 1 with special ink is included in addition to all of the steps of the process shown in FIG. 14. The additional step occurs between the step of attaching an extra picture of the applicant, rather than the picture attached to the application form 11, to the data sheet 65 with the personal data printed thereon and the step of optically exposing the photosensitive printing paper 40 to the data sheet 65 with the extra picture attached and the personal data printed thereto.

FIG. 23 shows a printer 160 for printing the optically readable personal data on the image receiving layer 1 of the idenficiation data bearing sheet 9, and developing and transferring a composite image formed in the photosensitive printing paper 40 to the image receiving layer 1. As shown, the printer 160 has an exposure table 161 on which an original sheet 162, with the data sheet 65 printed thereon and the extra picture attached thereto, is placed. The table 161 is made of a transparent glass. The original sheet 162 is illuminated by lamps 163 and is projected by means of a printing lens 164 through a shutter 165 onto the thermal transfer photosensitive printing paper 40 which is withdrawn from a paper cassette 170. The photosensitive printing paper 40 is withdrawn one frame at a time and is transported to an exposure position 172 to be exposed. After exposure, the exposed photosensitive printing paper 49 is cut by a cutter 171.

A water applicator 173 for applying water to the exposed photosensitive printing paper 40, a pressure applying roller 76, and a thermal image developing and printing unit 177 are provided after the exposure position 172. Below the water applicator 173, there is a container 175 in which a number of blank identification data bearing sheets 9 are stacked. The topmost identification data bearing sheet 9 is picked up and transported by means of a conveyor belt to superimpose the exposed photosensitive printing paper 40 over the image receiving layer 1 of the identification data bearing sheet 9 in the thermal image developing and printing unit 177 after having printed the optically readable personal data 1d on the image receiving layer 1 of the identification data bearing sheet 9 by a line printer 180. After the thermal image developing and printing unit 177, there are provided a printing paper remover 181 for removing the photosensitive printing paper from the image receiving layer 1 of the identification data bearing sheet 9, a wastepaper container 179 for receiving printing papers removed from the image receiving layer 1 of the identification data bearing sheet 9 by the printing paper remover 181, a dryer 182 for drying the passport 5, and a tray 178 for receiving the printed identification data bearing sheet 9.

The line printer 180 is linked to a controller 183. The controller 183 causes the line printer 180 to print necessary optically readable personal data described by optically readable characters, or a bar-code, in the optically readable personal data printing area 8 of the image receiving layer 1, adhered to the identification data bearing sheet 9. This optically readable personal data is retrieved from a floppy disk or the like in which the personal data described in the data sheet 65 has been recorded. Otherwise, the necessary personal data to be printed with optically readable characters may be entered through a keyboard. If desired, the personal data 1a as well as the optically readable personal data 1d may be printed by the line printer 180.

The booklet according to the present invention can be available as various personal booklets or personal cards with a picture of the face holders such as bankbooks, identification cards, driving licenses and so on. These booklets or cards are essential, in particular, in providing the bookholder's or carholder's identity. The booklet according to the present invention may also be provided with a magnetic strip.

The above description of the invention is intended to be illustrative and not limiting. Various changes or modifications in the embodiments described may occur to those skilled in the art and these can be made without departing from the scope of the invention.

What is claimed:

1. A booklet for identifying a holder thereof, said booklet being provided with a picture and personal data of said holder, which comprises:

a supporting sheet bound in said booklet;

an identification data bearing sheet adhered to one side of said supporting sheet, said data bearing sheet having an image receiving layer on which a composite image of said picture and personal data is formed; and a transparent sheet bound in said booklet adjacent to said supporting sheet, said transparent sheet being adhered to said one side of said supporting sheet to sandwich said identification data bearing sheet therebetween.

2. A booklet as defined in claim 1, wherein said composite image comprises an image optically printed on a thermal transfer type photosensitive printing paper and thermally transferred onto said image receiving layer.

3. A booklet as defined in claim 1, wherein said composite image comprises a computer-generated image.

4. A booklet as defined in claim 1, wherein said composite image comprises an optically provided image.

5. A booklet as defined in claim 1, wherein said transparent sheet includes a transparent adhesive layer adhered to one surface thereof.

6. A booklet as defined in claim 1, further comprising a transparent adhesive layer applied to said image receiving layer and to said supporting sheet.

7. A booklet as defined in claim 1, further comprising a transparent adhesive sheet for adhering said transparent sheet to said identification data bearing sheet.

8. A booklet for identifying a holder thereof, said booklet being provided with a picture and personal data of said holder, which comprises:

a transparent sheet and supporting sheet bound in said booklet adjacent to each other;

an identification data bearing sheet adhered to one side of said supporting sheet, said data bearing sheet having an image receiving layer on which a composite image of said picture and personal data is formed;

an optically readable data printing area having optically readable personal data of said booklet holder; and an adhesive layer for adhering said transparent and supporting sheets to sandwich said identification data bearing sheet therebetween as a single page in said booklet.

9. A booklet as defined in claim 8, said adhesive layer comprising a transparent adhesive layer previously adhered to said transparent sheet.

10. A booklet as defined in claim 9, wherein said image receiving layer of said identification data bearing sheet is comprised of an optically readable data printing area.

11. A booklet as defined in claim 9, wherein said transparent adhesive layer comprises said optically readable data printing area.

12. A booklet as defined in claim 9, wherein said adhesive layer is comprised of a double-faced adhesive sheet.

13. A booklet according to claims 8 or 11, wherein said optically readable data printing area is overlapped on said image receiving area.

14. A booklet as defined in claim 8, wherein said image receiving layer comprises an image thermally transferred from a photosensitive printing paper.

15. A booklet for identifying a holder thereof, said booklet being provided with a picture and personal data of said holder, which comprises:

a transparent sheet and a supporting sheet bound in said booklet adjacent to each other;

an identification data bearing sheet with an image receiving layer formed on one surface thereof, wherein said image receiving layer includes a composite image of said picture and said personal data, and optically readable personal data; and an adhesive layer for adhering said transparent and supporting sheets to sandwich said identification data bearing sheet therebetween.

16. A booklet as defined in claim 15, wherein said image receiving layer comprises said image thermally transferred from a photosensitive printing paper.

17. A booklet according to claims 15 or 16, wherein said adhesive layer comprises first and second adhesive layers disposed on respective inside surfaces of said transparent and supporting sheets.

* * * * *